US010926127B1

(12) United States Patent
Lagree et al.

(10) Patent No.: US 10,926,127 B1
(45) **Date of Patent: *Feb. 23, 2021**

(54) EXERCISE MACHINE ERGONOMIC HANDLE SYSTEM

(71) Applicant: Lagree Technologies, Inc., Chatsworth, CA (US)

(72) Inventors: Sebastien Anthony Louis Lagree, Chatsworth, CA (US); John C. Hamilton, Santa Clarita, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/096,117

(22) Filed: Nov. 12, 2020

Related U.S. Application Data

(63) Continuation of application No. 16/693,089, filed on Nov. 22, 2019, now Pat. No. 10,835,775, which is a (Continued)

(51) Int. Cl.
*A63B 22/00* (2006.01)
*A63B 21/055* (2006.01)
(Continued)

(52) U.S. Cl.
CPC ..... *A63B 22/0089* (2013.01); *A63B 21/023* (2013.01); *A63B 21/0428* (2013.01); *A63B 21/055* (2013.01); *A63B 21/4035* (2015.10); *A63B 21/4045* (2015.10); *A63B 22/0087* (2013.01); *A63B 22/203* (2013.01); *A63B 21/00065* (2013.01); *A63B 22/201* (2013.01);
(Continued)

(58) Field of Classification Search
CPC ..... A63B 22/0076–0089; A63B 23/02–0244; A63B 22/20–208
See application file for complete search history.

(56) References Cited

U.S. PATENT DOCUMENTS 131,886 A 10/1872 Little
1,621,477 A 8/1925 Pilates
(Continued)

FOREIGN PATENT DOCUMENTS

WO 2004/096376 A1 11/2004

OTHER PUBLICATIONS

Picture of a Product Developed by the Inventor, Sebastien Lagree; 2007.

(Continued)

*Primary Examiner* — Nyca T Nguyen
(74) *Attorney, Agent, or Firm* — Neustel Law Offices

(57) ABSTRACT

An exercise machine ergonomic handle system for providing hand-holds for the performance of exercises with reduced flexion and/or extension of the hand and wrist and reduced ulnar and/or radial deviation so as to reduce injury and allow application of full strength to the exercise machine. The exercise machine ergonomic handle system generally includes a longitudinally extending frame, a carriage that moves upon a first longitudinal portion of the frame, and at least one pair of ergonomic handles positioned on a second longitudinal portion of the frame. The ergonomic handles rotate about an axis to prevent flexion and/or extension, and can be positioned at a width and/or angle that reduces ulnar and/or radial deviation.

27 Claims, 5 Drawing Sheets

Related U.S. Application Data continuation of application No. 16/558,469, filed on Sep. 3, 2019, now Pat. No. 10,486,017, which is a continuation of application No. 16/119,793, filed on Aug. 31, 2018, now Pat. No. 10,518,127, which is a continuation of application No. 15/973,050, filed on May 7, 2018, now Pat. No. 10,065,069, which is a continuation of application No. 15/645,116, filed on Jul. 10, 2017, now Pat. No. 9,962,573, which is a continuation of application No. 14/860,273, filed on Sep. 21, 2015, now Pat. No. 9,700,754, which is a continuation of application No. 14/524,597, filed on Oct. 27, 2014, now Pat. No. 9,138,606.

(60) Provisional application No. 61/895,538, filed on Oct. 25, 2013.

(51) Int. Cl.

| | |
|---|---|
| ***A63B 21/02*** | (2006.01) |
| ***A63B 22/20*** | (2006.01) |
| ***A63B 21/04*** | (2006.01) |
| ***A63B 21/00*** | (2006.01) |
| ***A63B 23/02*** | (2006.01) |

(52) U.S. Cl.

CPC ..... *A63B 23/02* (2013.01); *A63B 2208/0219* (2013.01); *A63B 2209/02* (2013.01)

(56) References Cited

U.S. PATENT DOCUMENTS

| | | | |
|---|---|---|---|
| 1,866,868 | A | 7/1932 | Thomson |
| 2,223,309 | A | 11/1940 | Swanson |
| 3,589,720 | A | 6/1971 | Agamian |
| 3,746,338 | A | 7/1973 | Proctor |
| 3,770,267 | A | 11/1973 | McCarthy |
| 3,795,396 | A | 3/1974 | Kropelnitski |
| 3,806,094 | A | 4/1974 | Harken |
| 4,111,417 | A | 9/1978 | Gardner |
| 4,231,375 | A | 11/1980 | Boehringer |
| 4,541,627 | A | 9/1985 | Maclean |
| 4,620,701 | A | 11/1986 | Mojden |
| 4,650,184 | A | 3/1987 | Brebner |
| 4,695,050 | A | 9/1987 | Smith |
| 4,706,953 | A | 11/1987 | Graham |
| 4,709,918 | A | 12/1987 | Grinblat |
| 4,709,920 | A | 12/1987 | Schnell |
| 4,756,523 | A | 7/1988 | Rasmussen |
| 4,759,540 | A | 7/1988 | Yu |
| 4,798,378 | A | 1/1989 | Jones |
| 4,845,987 | A | 7/1989 | Kenneth |
| 4,865,317 | A | 9/1989 | Hickey |
| 4,911,438 | A | 3/1990 | Van Straaten |
| 4,915,377 | A | 4/1990 | Malnke |
| 5,007,632 | A | 4/1991 | Wilkinson |
| 5,064,189 | A | 11/1991 | Shiuh-Shinn |
| 5,066,005 | A | 11/1991 | Luecke |
| 5,072,929 | A | 12/1991 | Peterson |
| 5,108,093 | A | 4/1992 | Watterson |
| 5,139,471 | A | 8/1992 | Dornberger |
| 5,179,746 | A | 1/1993 | Rogers |
| 5,211,617 | A | 5/1993 | Millen |
| 5,263,913 | A | 11/1993 | Boren |
| 5,295,935 | A | 3/1994 | Wang |
| 5,358,462 | A | 10/1994 | Calderone |
| 5,374,226 | A | 12/1994 | Grahm |
| 5,380,259 | A | 1/1995 | Robertson |
| 5,429,567 | A | 7/1995 | Gerschefske |
| D362,700 | S | 9/1995 | Breibart |
| 5,503,609 | A | 4/1996 | Bull |
| D382,319 | S | 8/1997 | Gerschefske |
| 5,681,249 | A | 10/1997 | Endelman |
| 5,833,558 | A | 11/1998 | Connelly, III |
| 5,857,946 | A | 1/1999 | Brown |
| 5,885,197 | A | 3/1999 | Barton |
| 5,967,955 | A | 10/1999 | Westfall |
| 5,997,450 | A | 12/1999 | Wilkinson |
| 6,042,523 | A | 3/2000 | Graham |
| 6,045,491 | A | 4/2000 | McNergney |
| 6,071,217 | A | 6/2000 | Barnett |
| 6,179,753 | B1 | 1/2001 | Barker |
| 6,280,366 | B1 | 8/2001 | Hsieh |
| 6,315,695 | B1 | 11/2001 | Follett |
| 6,440,045 | B1 | 8/2002 | Gaston |
| 6,461,283 | B1 | 10/2002 | Maron |
| 6,527,685 | B2 | 3/2003 | Endelman |
| 6,634,996 | B2 | 10/2003 | Jacobsen |
| 6,652,425 | B1 | 11/2003 | Martin |
| 6,786,850 | B2 | 9/2004 | Nizamuddin |
| 6,817,968 | B2 | 11/2004 | Galbraith |
| 6,981,932 | B1 | 1/2006 | Huang |
| 7,090,621 | B2 | 8/2006 | Loane |
| 7,163,500 | B2 | 1/2007 | Endelman |
| 7,294,098 | B2 | 11/2007 | Barnard |
| 7,419,459 | B2 | 9/2008 | Van Straaten |
| 7,438,673 | B1 | 10/2008 | Jones |
| 7,654,941 | B2 | 2/2010 | Lacher |
| 7,803,095 | B1 | 9/2010 | Lagree |
| 7,806,805 | B2 | 10/2010 | Barufka |
| 7,819,777 | B1 | 10/2010 | Service |
| 7,931,570 | B2 | 4/2011 | Hoffman |
| 7,942,799 | B1 | 5/2011 | Boyd |
| 7,967,736 | B2 | 6/2011 | D'Silva |
| D659,205 | S | 5/2012 | Endelman |
| 8,430,800 | B2 | 4/2013 | Nolan |
| 8,500,611 | B2 | 8/2013 | Hoffman |
| 8,613,692 | B2 | 12/2013 | Baudhuin |
| 8,641,585 | B2 | 2/2014 | Lagree |
| 8,721,511 | B2 | 5/2014 | Endelman |
| 8,834,332 | B2 | 9/2014 | Campanaro |
| 8,894,551 | B2 | 11/2014 | Kerdjoudj |
| 8,961,373 | B2 | 2/2015 | Halver |
| 9,022,909 | B2 | 5/2015 | Kermath |
| 9,072,931 | B2 | 7/2015 | Lagree |
| 9,079,071 | B2 | 7/2015 | Allain |
| 9,119,989 | B1 | 9/2015 | Lagree |
| 9,138,606 | B2 | 9/2015 | Lagree |
| 9,180,332 | B1 | 11/2015 | Tenorio |
| 9,211,440 | B2 | 12/2015 | Lagree |
| 9,283,422 | B2 | 3/2016 | Lagree |
| 9,289,645 | B2 | 3/2016 | Masterson |
| 9,393,454 | B2 | 7/2016 | Lagree |
| 9,415,253 | B2 | 8/2016 | Lagree |
| 9,604,095 | B1 | 3/2017 | Lagree |
| 9,789,354 | B2 | 10/2017 | Lagree |
| 2001/0056011 | A1 | 12/2001 | Endelman |
| 2002/0058573 | A1 | 5/2002 | Endelman |
| 2003/0119635 | A1 | 6/2003 | Arbuckle |
| 2004/0009849 | A1 | 1/2004 | Galbraith |
| 2004/0043873 | A1 | 3/2004 | Wilkinson |
| 2004/0142800 | A1 | 7/2004 | Gerschefske |
| 2005/0085357 | A1 | 4/2005 | Endelman |
| 2005/0124471 | A1 | 6/2005 | Wilkinson |
| 2005/0164856 | A1 | 7/2005 | Parmater |
| 2006/0046914 | A1 | 3/2006 | Endelman |
| 2006/0199712 | A1 | 9/2006 | Barnard |
| 2007/0117693 | A1 | 5/2007 | Illio |
| 2007/0129226 | A1 | 6/2007 | Leavitt |
| 2007/0219053 | A1 | 9/2007 | Barufka |
| 2008/0070765 | A1 | 3/2008 | Brown |
| 2008/0248935 | A1 | 10/2008 | Solow |
| 2009/0111661 | A1 | 4/2009 | Hauser |
| 2009/0118108 | A1 | 5/2009 | Uygan |
| 2010/0227748 | A1 | 9/2010 | Campanaro |
| 2011/0130258 | A1 | 6/2011 | Gerschefske |
| 2011/0143898 | A1 | 6/2011 | Trees |
| 2011/0152036 | A1 | 6/2011 | Halver |
| 2011/0166002 | A1 | 7/2011 | Savsek |
| 2011/0172069 | A1 | 7/2011 | Gerschefske |
| 2012/0295771 | A1 | 11/2012 | Lagree |
| 2013/0017935 | A1 | 1/2013 | Endelman |
| 2013/0281269 | A1 | 10/2013 | Gerschefske |

(56) References Cited

U.S. PATENT DOCUMENTS

| | | | |
|---|---|---|---|
| 2014/0011645 | A1 | 1/2014 | Johnson |
| 2014/0100089 | A1 | 4/2014 | Kermath |
| 2014/0121076 | A1 | 5/2014 | Lagree |
| 2014/0121078 | A1 | 5/2014 | Lagree |
| 2014/0121079 | A1 | 5/2014 | Lagree |
| 2014/0141948 | A1 | 5/2014 | Aronson |
| 2014/0221182 | A1 | 8/2014 | Lin |
| 2015/0024914 | A1 | 1/2015 | Lagree |
| 2015/0057127 | A1 | 2/2015 | Lagree |
| 2015/0065318 | A1 | 3/2015 | Lagree |
| 2015/0065320 | A1 | 3/2015 | Anderson |
| 2015/0072841 | A1 | 3/2015 | Lagree |
| 2015/0141204 | A1 | 5/2015 | Lagree |
| 2015/0217164 | A1 | 8/2015 | Lagree |
| 2015/0220523 | A1 | 8/2015 | Lagree |
| 2015/0246258 | A1 | 9/2015 | Hockridge |
| 2015/0246263 | A1 | 9/2015 | Campanaro |
| 2015/0297944 | A1 | 10/2015 | Lagree |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0367166 | A1 | 12/2015 | Lagree |
| 2016/0008657 | A1 | 1/2016 | Lagree |
| 2016/0059060 | A1 | 3/2016 | Lagree |
| 2016/0059061 | A1 | 3/2016 | Lagree |
| 2016/0096059 | A1 | 4/2016 | Lagree |
| 2016/0166870 | A1 | 6/2016 | Lagree |
| 2016/0193496 | A1 | 7/2016 | Lagree |
| 2016/0256733 | A1 | 9/2016 | Lagree |
| 2016/0271452 | A1 | 9/2016 | Lagree |
| 2016/0317858 | A1 | 11/2016 | Lagree |
| 2016/0346593 | A1 | 12/2016 | Lagree |
| 2016/0361602 | A1 | 12/2016 | Lagree |
| 2017/0014664 | A1 | 1/2017 | Lagree |
| 2017/0014672 | A1 | 1/2017 | Lagree |

OTHER PUBLICATIONS

Picture of PROFORMER Exercise Machine by the Inventor, Sebastien Lagree; Dec. 31, 2008.

https://web.archive.org/web/20100501142110/http:/spxfitness.com/index.php?option=com_content&view=article&id=&Itemid=3; SPX Fitness Superformer Wayback Archive.org; May 1, 2010.

Pictures of MEGAFORMER M2 Exercise Machine Developed by the Inventor, Sebastien Lagree; Jan. 1, 2011.

Pictures of Megaformer Product Developed by the Inventor, Sebastien Lagree, Printed and Received Feb. 4, 2011.

https://web.archive.org/web/20121205030242/http:/www.lagreefitness.com:80/index.php?option=com_content&view=article&id=32&Itemid=3; Lagree Fitness Wayback Machine/Archive.org Page Introducing MegaFormer M3; Dec. 5, 2012.

https://web.archive.org/web/20160405173247/http://static.flickr.com/8480/8186598268_8390c9bc08_b.jpg; MegaFormer M3 Picture on WayBack Machine/Archive.org Page; Dec. 5, 2012.

https://twitter.com/LagreeFitness/status/635822521997242369; "Can you handle the Supraformer?" (@LAGREEFITNESS) Twitter Post; Aug. 24, 2015.

https://twitter.com/LagreeFitness/status/636555280218615808; "Los Angeles: Get ready for a one of kind workout!" (@LAGREEFITNESS) Twitter Post; Aug. 26, 2015.

PCT International Search Report and Written Opinion for PCT/US2016/58178; dated Jan. 13, 2017.

Pictures of Megaformer M3 Exercise Machine Developed by the Inventor, Sebastien Lagree; Dec. 15, 2012.

EXERCISE MACHINE ERGONOMIC HANDLE SYSTEM

CROSS REFERENCE TO RELATED APPLICATIONS

The present application is a continuation of U.S. application Ser. No. 16/693,089 filed on Nov. 22, 2019 which issues as U.S. Pat. No. 10,835,775 on Nov. 17, 2020, which is a continuation of U.S. application Ser. No. 16/558,469 filed on Sep. 3, 2019 now issued as U.S. Pat. No. 10,486,017, which is a continuation of U.S. application Ser. No. 16/119,793 filed on Aug. 31, 2018 now issued as U.S. Pat. No. 10,518,127, which is a continuation of U.S. application Ser. No. 15/973,050 filed on May 7, 2018 now issued as U.S. Pat. No. 10,065,069, which is a continuation U.S. application Ser. No. 15/645,116 filed on Jul. 10, 2017 now issued as U.S. Pat. No. 9,962,573, which is a continuation of U.S. application Ser. No. 14/860,273 filed on Sep. 21, 2015 now issued as U.S. Pat. No. 9,700,754, which is a continuation of U.S. application Ser. No. 14/524,597 filed on Oct. 27, 2014 now issued as U.S. Pat. No. 9,138,606, which claims priority to U.S. Provisional Application No. 61/895,538 filed Oct. 25, 2013. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND OF THE INVENTION

Field of the Invention

The present invention relates generally to an exercise machine and more specifically it relates to an exercise machine ergonomic handle system for reducing physical strain on an exerciser during exercises.

Description of the Related Art

Any discussion of the related art throughout the specification should in no way be considered as an admission that such related art is widely known or forms part of common general knowledge in the field.

Exercise machines have been in use for many years. One common exercise machine that has enjoyed increasing popularity is the Pilates machine. A conventional Pilates machine generally includes a frame, a track extending across the frame, one or more platforms at the end of the frame, one or more handles extending directly or indirectly from the frame and a carriage movably connected to the track. The carriage is connected to one end of the frame by one or more bias members such as springs. U.S. Pat. Nos. 7,803,095 and 8,641,585 to Sebastien Lagree both disclose exemplary exercise machines suitable for Pilates exercises and additional exercises. While conventional Pilates machines are acceptable for many exercises, they can result in significant strain on the exerciser's arms, wrists and hands during extension type exercises because of the non-movability of the handles during the exercise.

Because of the inherent problems with the related art, what would be useful is an exercise machine ergonomic handle system for reducing physical strain on an exerciser during exercises.

BRIEF SUMMARY OF THE INVENTION

The invention generally relates to an exercise machine that includes handles configured to rotate about an axis encompassed by the handles in order to improve the ergonomics of using the exercise machine. The exercise machine may be a Pilates type machine adapted with an ergonomic handle system to provide hand-holds for the performance of exercises with reduced flexion and/or extension of the hand and wrist and reduced ulnar and/or radial deviation so as to reduce injury and allow application of full strength to the exercise machine. The exercise machine ergonomic handle system generally includes a longitudinally extending frame, a carriage that moves upon a first longitudinal portion of the frame, and at least one pair of ergonomic handles positioned on a second longitudinal portion of the frame. The ergonomic handles rotate about an axis to prevent flexion and/or extension, and can be positioned at a width and/or angle that reduces ulnar and/or radial deviation.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
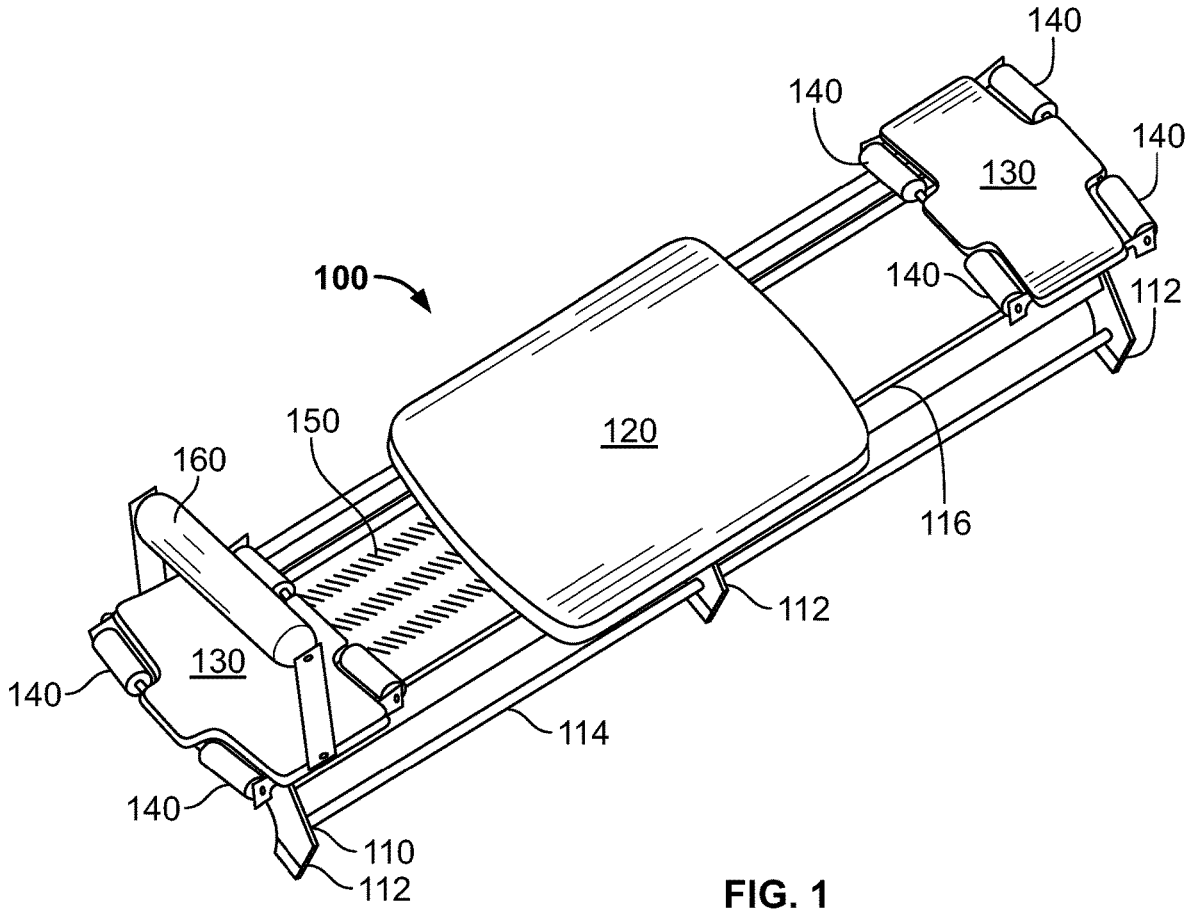
FIG. 1 is an upper perspective view of an embodiment of the present invention.

Turning now descriptively to the drawings, in which similar reference characters denote similar elements throughout the several views, FIGS. 1 through 4 illustrate various aspects and embodiments of an exercise machine ergonomic handle system 100, which comprises a carriage 120 slidably positioned upon a frame 110 via one or more rails 116. A plurality of handles 140 are attached directly to the frame 110 or indirectly to the frame 110 via one or more platforms 130. Each handle 140 rotates about an axis 108 that is encompassed by the handle 140 and typically in substantially the same horizontal plane as the carriage 120. The system 100 includes at least one pair of handles 140 positioned outside the longitudinal range of motion of the carriage 120, but may also optionally comprise multiple pairs of handles 140. The handles 140 are typically used in pairs that are preferably positioned an ergonomic distance W apart on opposing sides of a longitudinal axis, and preferably positioned with the rotational axis 108 at an ergonomic angle θ. When mounted on or near the platforms 130, the handles 140 may be positioned within cutouts 145 in the platforms 130. U.S. Pat. Nos. 7,803,095 and 8,641,585 to Sebastien Lagree both disclose exemplary exercise machines and are hereby incorporated by reference herein.

B. Exercise Machine

FIGS. 1-4 illustrate aspects of exemplary exercise machines 100 for use with the present invention. In particular, the present invention is preferably utilized within a Pilates exercise machine 100 as illustrated in FIGS. 1-4. While the figures and description illustrate and describe the exercise machine 100 as being comprised of a Pilates machine, it is appreciated that the present invention may be utilized in combination with other exercise machines such as weight machines and the like.

Figure 2A:
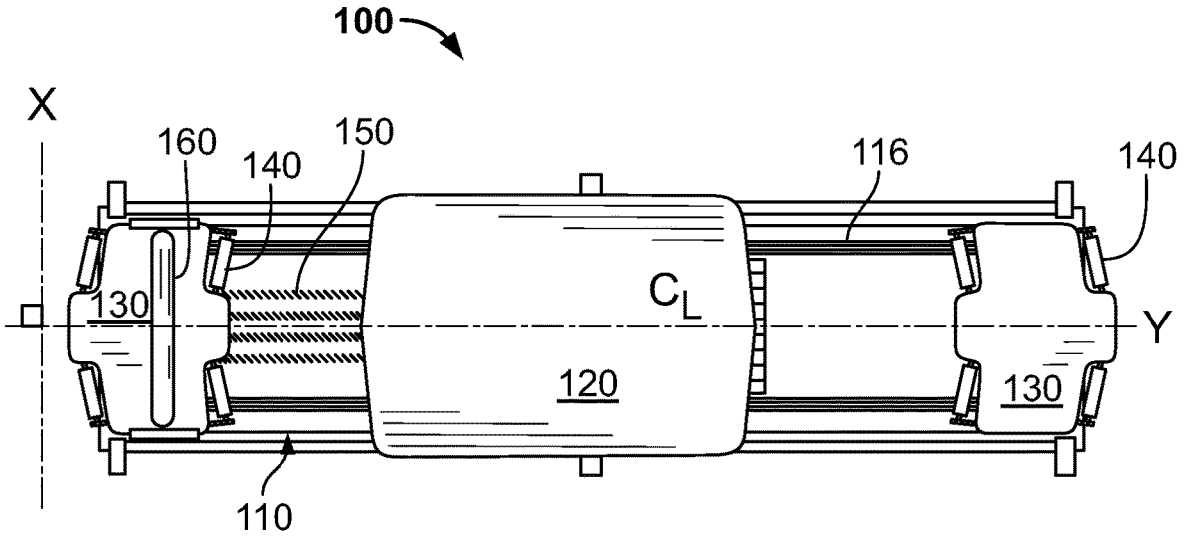
FIG. 2A is a top view of an embodiment of the present invention.
Figure 2B:
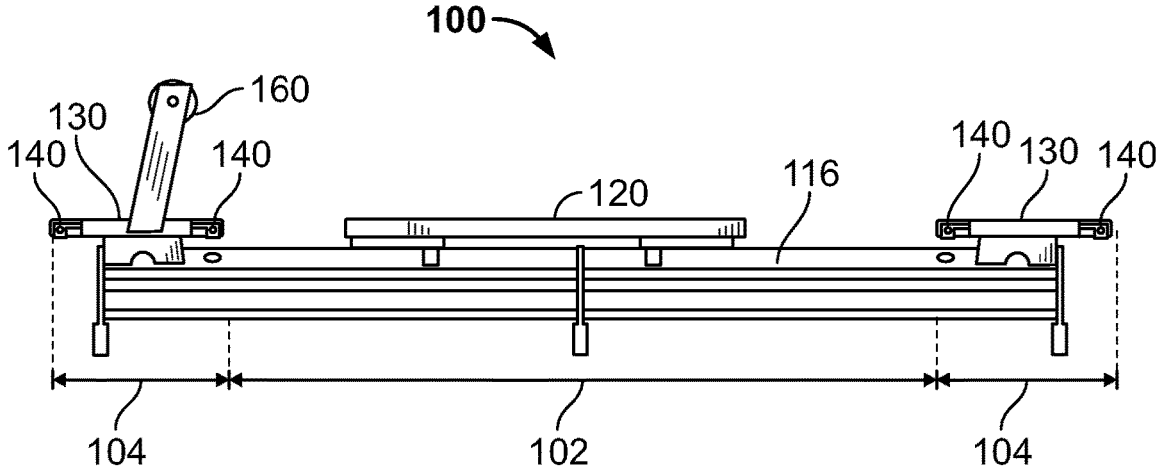
FIG. 2B is a side view of an embodiment of the present invention.

FIGS. 1, 2A and 2B illustrate an embodiment of an exercise machine or exercise machine ergonomic handle system (hereinafter 'exercise machine') 100. The exemplary embodiment comprises a frame 110 including transverse legs 112 connected by longitudinal supports 114. The frame 110 may also take other suitable forms, such as a rectangular box or a lattice structure, without departing from the scope of the invention. The frame 110 may further be formed of any suitable material, including wood (solid, plywood, pressed fiberboard), metal (steel, aluminum, magnesium, alloys, etc.), high-strength plastic (PVC, HDPE, etc.), composites (fiberglass, carbon fiber, fiber-reinforced plastic, etc.), and combinations thereof. Rails 116 extend longitudinally between ends of the frame 110 or longitudinally between platforms 130. The rails 116 may comprise part of the frame 110, or may be attached separately thereto, and may be adapted or angled to support complementary elements on the carriage 120.

An exemplary exercise machine 100 further comprises platforms 130 at or near both ends of the frame 110, although one or both may optionally be omitted. As used herein, the term "near" encompasses platforms 130 that at least partially overhang an end of the frame 110, as illustrated in FIGS. 1 through 4, platforms 130 that are flush with an end of the frame 110, and platforms 130 that are positioned between an end of the frame 110 and the carriage 120. These platforms 130 may be referred to first and second platforms 130, or, within the Pilates art, as head and foot platforms 130. The platforms 130 may be attached directly to the frame 110 or may be attached indirectly to the frame 110, such as via rails 116. As illustrated, exemplary platforms 130 in FIGS. 1, 2A and 2B are generally rectangular and have cutouts 145 in each corner to provide a standoff distance for the mounting and utilization of handles 140 in substantially the same plane as the platforms 130. The platforms 130 may further be formed of any suitable material, including wood (solid, plywood, pressed fiberboard), metal (steel, aluminum, magnesium, alloys, etc.), high-strength plastic (PVC, HDPE, etc.), composites (fiberglass, carbon fiber, fiber-reinforced plastic, etc.), and combinations thereof, and may further include padding or texturing on an upper surface. The platforms 130 include a portion 132 that extends centrally as shown in FIG. 4 of the drawings.

The exemplary embodiment of FIGS. 1, 2A and 2B further includes a foot bar 160 on one of the platforms 130. The foot bar 160 typically comprises vertical supports and a padded bar extending therebetween transverse to the longitudinal axis. The foot bar 160 may be integral to the platform 130, or may be removable, adjustable, and/or foldable (not illustrated). The foot bar 160 may be used for performing various exercises, including Pilates movements.

An exemplary exercise machine 100 further comprises a carriage 120 mounted to move longitudinally upon rails 116 between platforms 130. As discussed in further detail with respect to FIGS. 3A-3D, the carriage 120 is operatively connected to the frame 110 via springs 150 to provide a tension force when the carriage 120 is moved by a user during the performance of exercises.

In one embodiment, the exercise machine 100 comprises a frame 110 having a longitudinal axis (designated as $C_L$ in FIGS. 2A and 4), a carriage 120 positioned upon the frame 110, wherein the carriage 120 is adapted to be movable along a first portion of the longitudinal axis (designated as 102 in FIG. 2B), and a pair of handles 140 attached directly or indirectly to the frame 110 on opposing sides of a second portion of the longitudinal axis (designated as 104 in FIG. 2B), wherein each handle 140 is configured to rotate about an axis (designated 108 in FIG. 4) encompassed by the handle 140. While the handles 140 may be attached directly to the frame 110, they may also be attached indirectly to the frame 110, such as by being attached to a platform 130 that is fixed to the frame 110 near one of its ends.

In another embodiment, the exercise machine 100 comprises a frame 110 having a first end, a second end, and a longitudinal axis (designated as $C_L$ in FIGS. 2A and 4) extending therebetween, at least one platform 130 attached to the frame 110 near an end (e.g., a first end), a carriage 120 positioned upon the frame 110 between the first and second ends, wherein the carriage 120 is adapted to be movable along a first portion of the longitudinal axis (designated as 102 in FIG. 2B), at least one spring 150 positioned between the frame 110 and the carriage 120 to provide a tensile or tension force on the carriage 120, and a first pair of handles 140 attached to the platform 130 or fixed near the platform 130 on opposing sides of the longitudinal axis, wherein each handle 140 is configured to rotate about a central axis 108 encompassed by the handle 140.

In a further embodiment, the exercise machine 100 comprises a frame 110 having a first end, a second end, and a longitudinal axis (designated as $C_L$ in FIGS. 2A and 4) extending therebetween, at least one platform 130 attached to the frame 110 near an end (e.g., a first end), a carriage 120 positioned upon the frame 110 between the first and second ends, wherein the carriage 120 is adapted to be movable along a first portion of the longitudinal axis (designated as 102 in FIG. 2B), at least one pair of handles 140 attached to the platform 130 or fixed near the platform 130 with one handle 140 of each pair positioned on opposing sides of the longitudinal axis. Each handle 140 in this further embodiment is configured to rotate about a central axis 108 encompassed by the handle 140, each pair of handles 140 comprises portions positioned between approximately 13 inches and 15 inches apart (between approximately 33 cm and 38 cm apart), and the central axis 108 of each handle 140 is positioned at an angle between approximately 95° and 112° as measured relative to an extension of the longitudinal axis between each pair of handles 140 and beyond the first end of the frame 110.

C. Ergonomic Handles

An embodiment of the ergonomic handles 140 that are disclosed generally in FIGS. 1, 2A-2B and 3A-3D is illustrated in more detail in FIG. 4, which shows a platform 130 at one end of an exemplary exercise machine 100, and the ergonomic handles 140 employed in the embodiment.

In the embodiment of FIG. 4, the platform 130 is attached near the end of frame 110 (illustrated with a slight overhang). The frame 110 is shown as slightly wider than platform 130, and such an arrangement aids in the stability of the exercise machine 100. The platform 130 is substantially rectangular, and includes cutout 145 portions for mounting of handles 140. The handle mounting structure may be connected to either the frame 110 or the platform 130. While the cutouts 145 are shown as being in the edge of platform 130, it is also possible to use cutouts 145 that are formed as apertures (not shown) in platform 130. It is further possible to mount handles 140 near the platform 130 at a standoff distance without the use of any cutouts 145. The cutouts 145 shown in FIG. 4 provide a standoff distance between each handle 140 and the inner edge (or outer edge) of the platform 130 so as to allow a user's hand to grip and rotate about the handle 140 without the user's fingers or hand contacting the platform 130. FIG. 4 illustrates an opening formed between each handle 140 and the platform 130 that is large enough to allow a hand to be inserted through as illustrated in FIGS. 3A through 3D of the drawings. As best shown in the embodiment shown in FIG. 4, each opening formed between the handles 140 and the platform 130 are elongated and extends in a direction substantially parallel with respect to the corresponding handle 140. The edges and corners of the cutouts 145 may be rounded or smooth to lessen the impact of incidental contact.

Pairs of handles 140 are positioned with left and right handles 140 on opposite sides of a centerline $C_L$ formed by the longitudinal axis. Although shown as equidistant from the centerline $C_L$ and in the same transverse and horizontal locations, this is not meant as a limitation, and it is possible to have the handles 140 in each pair offset from one another. The platform 130 shown in FIG. 4 has two pairs of handles 140, with one pair at a proximal end closer to the user and the carriage 120, and a second pair at a distal end of platform 130, farther away from the user and the carriage 120. Such locations provide hand-holding positions that may accommodate users of various sizes or be used for different exercises.

Each of the handles 140 may have a length of any suitable size that does not impede use of the machine 100. However, it has been found that a length of approximately 6 inches to 6.5 inches (approximately 15 to 16.5 cm) can accommodate the majority of user's hands without taking too much space away from the platform 130 or interfering with other uses of the exercise machine 100. Although illustrated as substantially cylindrical, the handles 140 are not limited to this form and may take other forms, including but not limited to prismatic shapes, frusticonical shapes, molded grip shapes, saddle shapes, and combinations thereof (not shown). The handles 140 are rotatable about an axis, preferably a central axis 108 that is encompassed (at least partially) by the exterior shape of the handle 140. As discussed further with respect to FIGS. 3A-3D, the ability of the handle 140 to rotate can reduce flexion and extension during use.

Additionally, the placement of the center of the handles 140 at a width W that approximates the shoulder width (biacromial) of a majority of users can also help reduce ulnar and radial deviation during use. The biacromial width of the $5^{th}$ percentile female is 13.12 inches, the biacromial width of the $95^{th}$ percentile male is 16.78 inches, and the midpoint of the two is 14.95 inches. However, it has been found that the range of ulnar deviation is angularly wider than radial deviation for an equivalent reduction in hand strength. Therefore, biasing the dimensions so that the largest person would experience slightly wider ulnar deviation is preferable to a smallest person experiencing a more extreme radial deviation. As such, it has been found that an approximate distance between the centers of 6 inch wide handles 140 of approximately 14 inches is preferred for reduction of ulnar and radial deviation during use. However, width W ranges between centers of handles 140 of in the range of approximately 13 inches to 15 inches (between approximately 33 cm and 38 cm apart) will still act to acceptably reduce ulnar and/or radial deviation.

In order to further reduce ulnar and/or radial deviation, the axis 108 of each handle 140 is preferably positioned at an ergonomic angle θ as measured relative to an extension of the longitudinal axis between the handles 140 and beyond an end of the frame 110, as illustrated in FIG. 4. The angle θ is preferably obtuse. It has been found that an angle θ between approximately 95° and 112° will generally work to reduce musculoskeletal stress on a majority of users, with an angle θ between approximately 96° and 98° being preferred, and an angle θ of approximately 97° being the most preferred.

Although illustrated as fixed in position, it is further possible to allow adjustability of the width W and/or the angle θ of handles 140 within the disclosed ranges via an adjustable handle mounting structure (not shown) that uses locking detents, a sliding/clamping mechanism or the like. Additionally, although disclosed in FIG. 4 as having identical widths W and angles θ, the proximal and distal pairs of handles 140 may have different widths W and angles θ within the acceptable disclosed ranges or outside of these ranges (so long as one pair falls within the ranges). The handles 140 may be cylindrical in form, may have an approximately 1¼ inch diameter, and may be covered with a grip or cushion grip. A bearing or bushing surface (not shown) for rotation of the handles 140 may be located either in the mounting structure or be part of the handle 140.

D. Operation of Preferred Embodiment

Figure 3A:
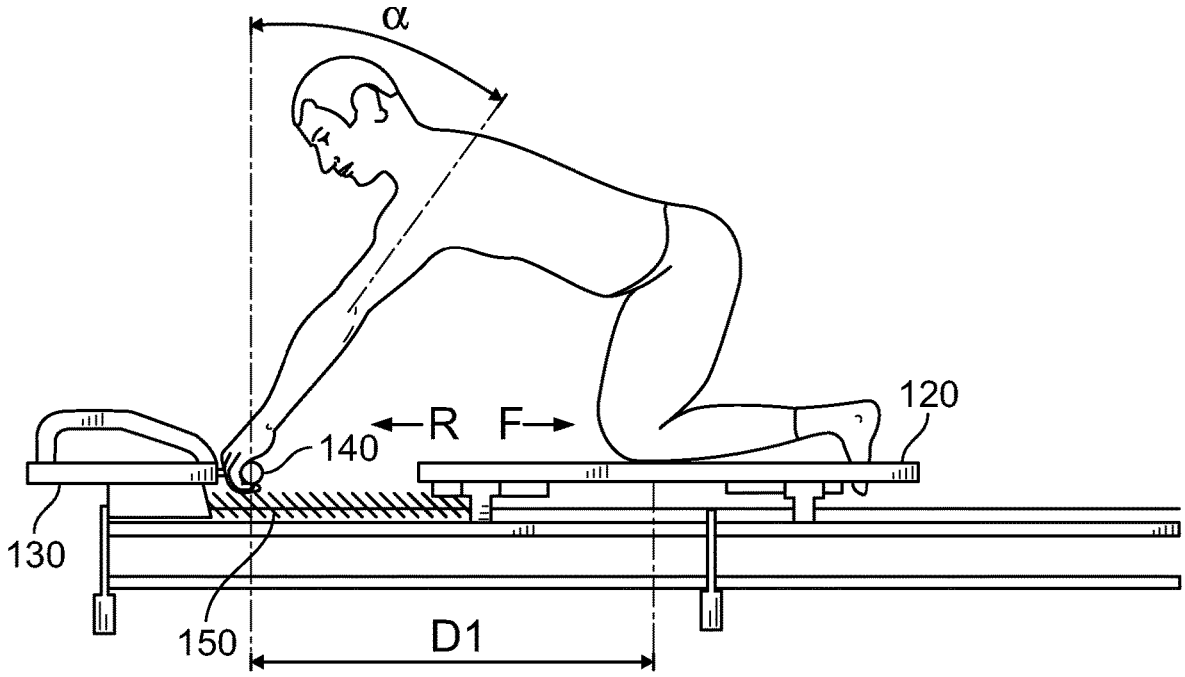
FIG. 3A is a side view of another embodiment of the present invention in a first position of use.
Figure 3B:
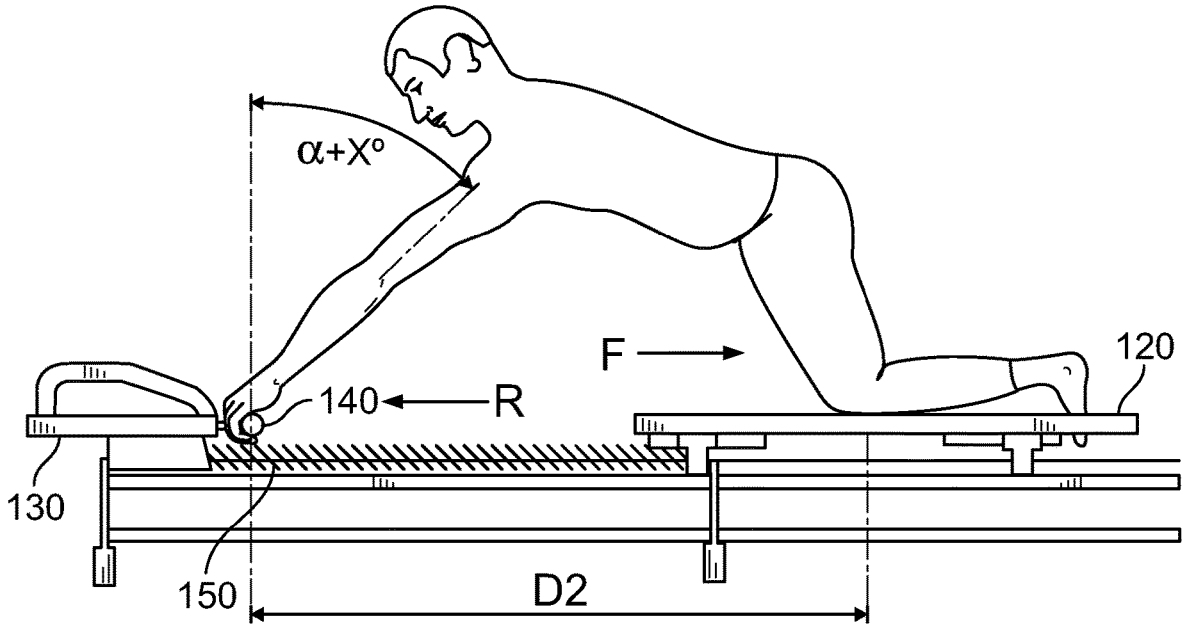
FIG. 3B is a side view of another embodiment of the present invention in a second position of use.
Figure 3C:
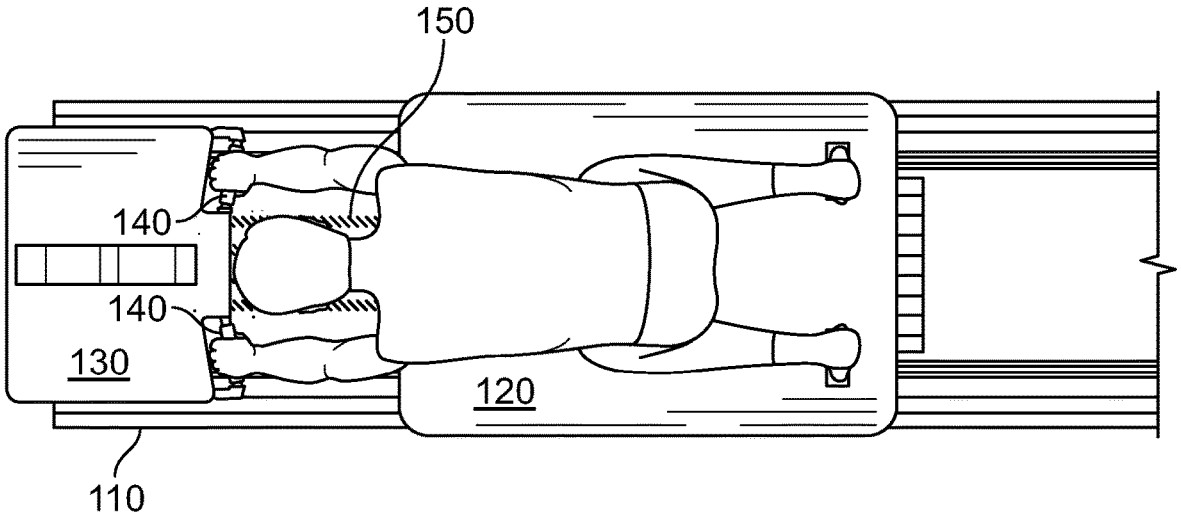
FIG. 3C is a top view of another embodiment of the present invention in a first position of use.
Figure 3D:
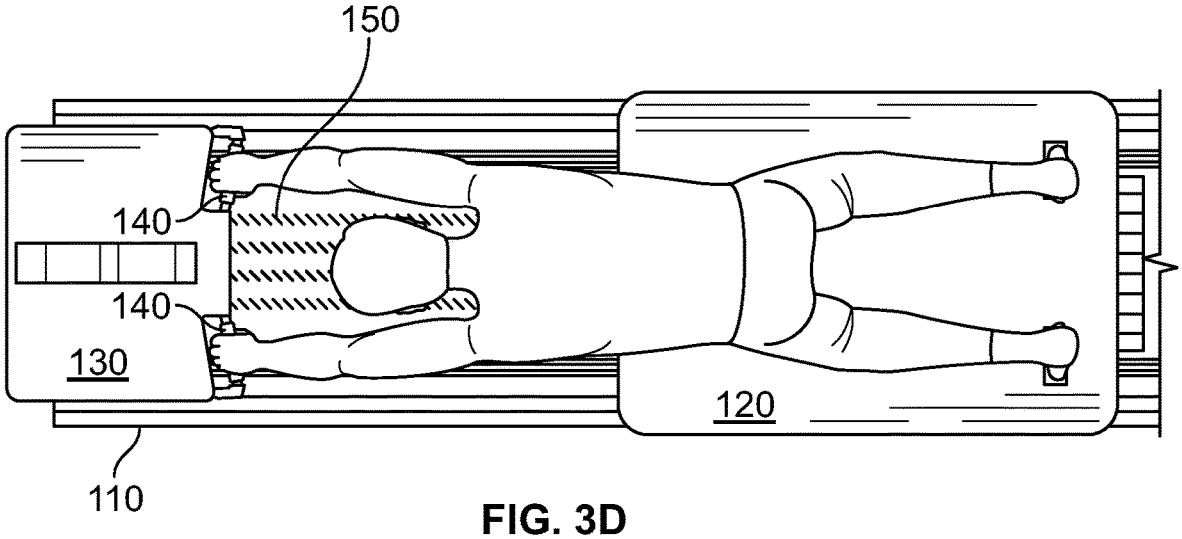
FIG. 3D is a top view of another embodiment of the present invention in a second position of use.
Figure 4:
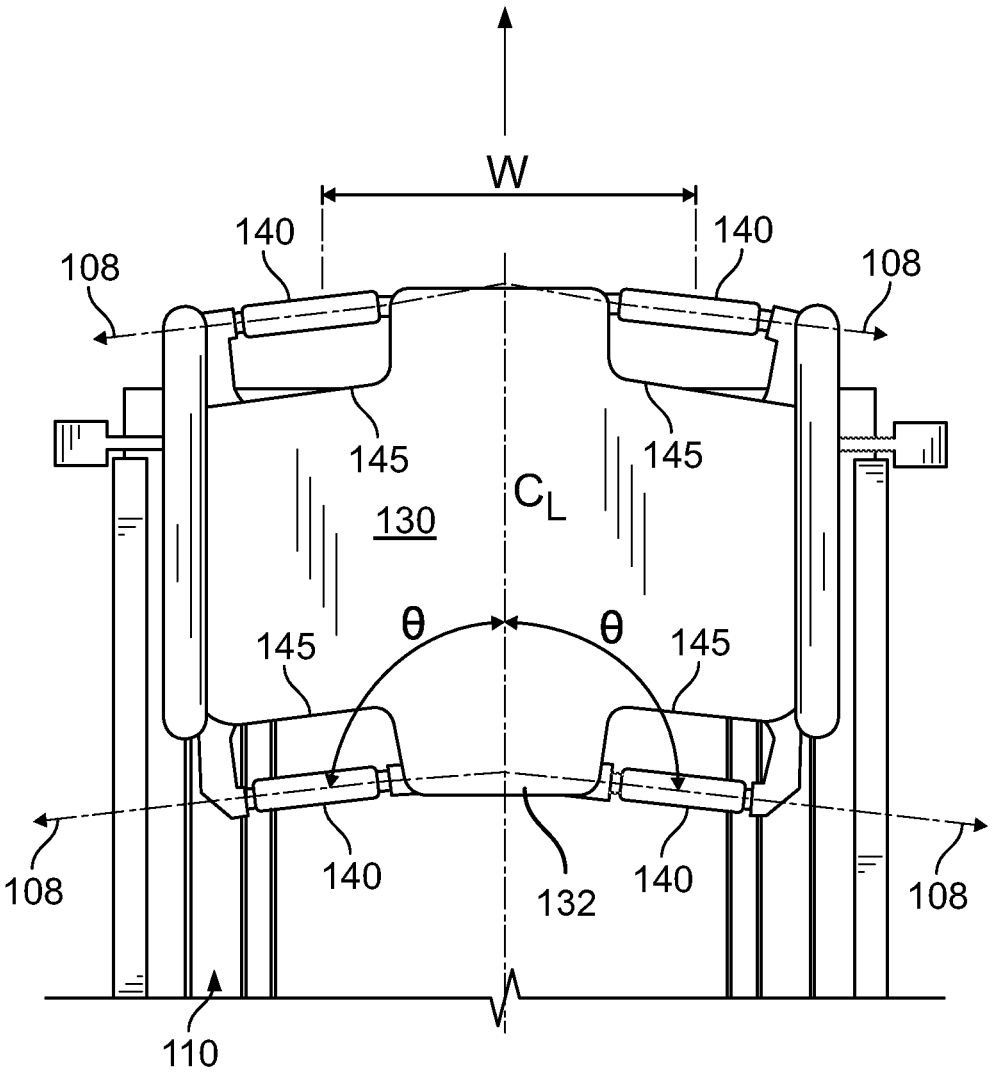
FIG. 4 is a detailed view of a portion of an embodiment illustrating details of ergonomic handles in accordance with the present invention.

In use, the handles 140 may be gripped by a user during performance of an exercise on an exercise machine 100, as shown in FIGS. 3A-3D. In FIGS. 3A and 3C, a user is positioned on the carriage 120 mounted on the frame 110 and grips the handles 140 near the platform 130. At position D1, the user's arms reach out and their hands grip the handles 140 at an angle α. A user may apply force F to the carriage 120 that is counteracted by a resistance force R from the springs 150. In FIGS. 3B and 3D, the user has moved the carriage 120 to position D2 as part of performing the exercise via an increased force F applied through the handles 140 against an increased resistance force from the springs 150. The user's arms and hands are now at an angle α+X°, but because the handles 140 are able to rotate, the user's hands are not subject to flexion or extension due to the change in angle during the exercise movement from D1 to D2. Without flexion or extension, the user can apply full strength during the exercise to maximize effectiveness of the exercise.

With ergonomic positioning of the width W and angle θ of the handles 140, ulnar and radial stresses are minimized to prevent injury. More specifically, the positioning of the handles 140 at a width W approximating the width of the user's shoulders places the arms and wrists in natural alignment with the handles 140 to reduce ulnar and radial deviation. Positioning the angle θ of the handles 140 at an ergonomic angle approximating a natural alignment of the user's hands and wrist relative to the user's shoulder similarly reduces ulnar and radial deviation.

In this manner, the disclosed embodiments of an exercise machine ergonomic handle system 100 in accordance with the present invention provides beneficial ergonomic handholding features that prevent injury of the wrist and connective tissue during the performance of an exercise.

E. Embodiments

In a basic embodiment, the exercise machine 100 includes a frame 110 having a longitudinal axis and a carriage 120 positioned upon the frame 110, typically via one or more rails 116. The carriage 120 is adapted to be movable along a first portion of the longitudinal axis 102, typically by rolling or sliding on one or more rails 116. A pair of handles 140 is attached directly or indirectly to the frame 110 on opposing sides of a second portion of the longitudinal axis 104, and each handle 140 is configured to rotate about an axis 108 encompassed by said handle 140 for improved ergonomics. Variations of the basic embodiment may include one or more additional aspects, which may also be used in combination.

The ergonomics of the handles 140 in the basic embodiment can further be advanced by one of more additional dimensional aspects. For example, the handles 140 may have an axial length of approximately 6 inches to 6.5 inches (approximately 15 cm to 16.5 cm) so as to fit a wide variety of users' hand sizes without occupying too much space on the machine 100. Similarly, the centers of the handles 140 may be positioned between approximately 13 inches and 15 inches apart (between approximately 33 cm and 38 cm apart) so as to limit the ulnar and radial deviation for the majority of users. Ulnar and radial deviation for the majority of users may also be limited by positioning the axis of each handle 140 within a specified angular range, as discussed in further detail below. The handles 140 in the basic embodiment may also be substantially cylindrical and rotate about a central axis 108.

The basic embodiment may optionally include a platform 130 fixed to the frame 110 along the second portion of said longitudinal axis 104. The platform 130 may optionally comprise cutouts 145 on opposing sides of the second portion of the longitudinal axis 104 in which the handles 140 can be positioned. The platform 130 may also include a foot bar 160.

The basic embodiment of the exercise machine 100 may take the form of a Pilates machine and include a spring 150 positioned between the frame 110 and the carriage 120 to provide a tensile or tension force to the carriage 120 for performance of Pilates exercises.

In a second embodiment, the exercise machine 100 may generally take the form of a Pilates machine, and the exercise machine 100 includes a frame 110 having a first end, a second end, and a longitudinal axis extending therebetween. At least one platform 130 is attached to the frame 110 on one of the ends. A carriage 120 is positioned on the frame 110 between said first and second ends, typically via one or more rails 116. The carriage 120 is adapted to be movable along a first portion of said longitudinal axis 102, typically by sliding or rolling on one or more rails 116. At least one spring 150 is positioned between the frame 110 and said carriage 120 to provide a tensile or tension force to the carriage 120. A first pair of handles 140 is attached to the platform 130 or fixed near the platform 130 on opposing sides of the longitudinal axis, with each handle 140 again configured to rotate about a central axis 108 encompassed by the handle 140. Variations of the second embodiment may include one or more additional aspects, which may also be used in combination.

The ergonomics of the handles 140 in the second embodiment can further be advanced by one of more additional dimensional aspects. For example, the handles 140 may have an axial length of approximately 6 inches (approximately 15 cm) so as to fit a wide variety of users' hand sizes without occupying too much space on the machine 100. Similarly, the centers of the handles 140 may be positioned between approximately 13 inches and 15 inches apart (between approximately 33 cm and 38 cm apart) so as to limit the ulnar and radial deviation for the majority of users. Further, the ulnar and radial deviation for the majority of users may also be limited by positioning the axis of each handle 140 within a specified angular range, as discussed in further detail below. The handles 140 in the second embodiment may also be substantially cylindrical and rotate about a central axis 108.

The second embodiment may further include a second pair of handles 140 attached to the platform 130 or fixed near the platform 130 on opposing sides of the longitudinal axis at a distance spaced along the longitudinal axis from said first pair of handles 140. The platform 130 in the second embodiment may also include cutouts 145 on opposing sides of the longitudinal axis, with the handles 140 being positioned in the cutouts 145.

The second embodiment may also include a second platform 130 attached near the other end of the frame 110. The second platform 130 may include a pair of additional handles 140 attached to the second platform 130 or fixed near the second platform 130 on opposing sides of the longitudinal axis, wherein each additional handle 140 is configured to rotate about a central axis 108 encompassed by the additional handle 140.

In a third embodiment, the exercise machine 100 includes a frame 110 having a first end, a second end, and a longitudinal axis extending therebetween. At least one platform 130 is attached to the frame 110 near the first end, and a carriage 120 is positioned on the frame 110 between said first and second ends, typically via one or more rails 116. The carriage 120 is adapted to be movable along a first portion of said longitudinal axis 102, typically by rolling or sliding on one or more rails 116. At least one pair of handles 140 is attached to the platform 130 or fixed near the platform 130, with one handle 140 of each pair positioned on opposing sides of the longitudinal axis. In this third embodiment, the handles 140 have further ergonomic aspects such that: each handle 140 is configured to rotate about a central axis 108 encompassed by said handle 140; each pair of handles 140 comprises portions positioned between approximately 13 inches and 15 inches apart (between approximately 33 cm and 38 cm apart); and the central axis 108 of each handle 140 is positioned at an angle between approximately 95° and 112° as measured relative to an extension of the longitudinal axis between each pair of handles 140 and beyond the first end of the frame 110. Variations of the third embodiment may include one or more additional aspects, which may also be used in combination.

Although the handles 140 are disclosed in each of these embodiments as being configured to rotate about an axis 108 encompassed by the handle 140, it is also possible to use the other disclosed positional aspects of width W and angle θ with non-rotating or limited rotating handles 140, although such an arrangement is not preferred. Additionally, the invention may be usable in combination with other handle systems such as the adjustable bar members disclosed in U.S. Pat. No. 8,641,585 to Sebastien Lagree.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. An exercise machine ergonomic handle system has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having a first end, a second end opposite of the first end, and at least one rail;

a carriage movably positioned upon the at least one rail and wherein the carriage includes an upper surface;

a first tension member adapted to be connected to the carriage to provide a tension force to the carriage;

a first platform attached to the frame near the first end of the frame, wherein the first platform includes a first upper surface and an inner edge, wherein the inner edge of the first platform faces a direction generally towards the carriage;

a handle having a longitudinal axis, wherein the longitudinal axis of the handle is in a fixed position near or on a plane formed by the first upper surface of the first platform;

wherein the longitudinal axis of the handle, the upper surface of the carriage and the first upper surface of the first platform are parallel to one another;

wherein the handle includes a first end and a second end opposite of the first end of the handle, wherein the first end and the second end of the handle are connected to the first platform;

wherein the first platform includes a cutout positioned at the inner edge of the first platform, wherein the handle is at least partially positioned within the cutout; and an opening between the handle and the inner edge of the first platform, wherein the opening is large enough to allow a plurality of fingers of a hand of an exerciser to be inserted into the opening, wherein the handle is distally spaced from the inner edge of the first platform by a distance sufficient for the plurality of fingers to extend into the opening between the handle and the inner edge of the first platform;

wherein the opening is elongated and extends in a direction substantially parallel with respect to the handle.

2. The exercise machine of claim 1, wherein the handle is cylindrical.

3. The exercise machine of claim 2, wherein the handle has a diameter of approximately 1¼ inches.

4. The exercise machine of claim 1, wherein the handle is rotatable about the longitudinal axis of the handle.

5. The exercise machine of claim 1, wherein the first tension member is comprised of a spring.

6. The exercise machine of claim 1, including a second tension member adapted to be connected to the carriage to provide a tension force to the carriage.

7. The exercise machine of claim 1, wherein the at least one rail is comprised of a first rail and a second rail.

8. The exercise machine of claim 1, wherein the handle is covered with a grip or a cushion grip.

9. The exercise machine of claim 1, wherein the first platform includes a portion that extends centrally.

10. The exercise machine of claim 1, including a second platform attached to the frame near the second end of the frame.

11. A method of using the exercise machine of claim 1, comprising:

positioning the exerciser on the carriage;

gripping the handle with the hand of the exerciser with the plurality of fingers of the hand extending through the opening; and applying a force to the carriage by the exerciser.

12. An exercise machine, comprising:

a frame having a first end, a second end opposite of the first end, a first rail, and a second rail that is parallel to the first rail;

a carriage movably positioned upon the first rail and the second rail, wherein the carriage includes an upper surface;

a first tension member and a second tension member each adapted to be connected to the carriage to provide a tension force to the carriage;

a first platform attached to the frame near the first end of the frame, wherein the first platform includes a first upper surface and an inner edge, wherein the inner edge of the first platform faces a direction generally towards the carriage;

a handle having a longitudinal axis, wherein the longitudinal axis of the handle is in a fixed position near or on a plane formed by the first upper surface of the first platform;

wherein the longitudinal axis of the handle, the upper surface of the carriage and the first upper surface of the first platform are parallel to one another;

wherein the handle includes a first end and a second end opposite of the first end of the handle, wherein the first end and the second end of the handle are connected to the first platform;

wherein the first platform includes a cutout positioned at the inner edge of the first platform, wherein the handle is at least partially positioned within the cutout; and an opening between the handle and the inner edge of the first platform, wherein the opening is large enough to allow a plurality of fingers of a hand of an exerciser to be inserted into the opening, wherein the handle is distally spaced from the inner edge of the first platform by a distance sufficient for the plurality of fingers to extend into the opening between the handle and the inner edge of the first platform;

wherein the opening is elongated and extends in a direction substantially parallel with respect to the handle.

13. The exercise machine of claim 12, wherein the handle is rotatable about the longitudinal axis of the handle.

14. The exercise machine of claim 12, wherein the handle is cylindrical.

15. The exercise machine of claim 12, wherein the handle is covered with a grip or a cushion grip.

16. The exercise machine of claim 12, wherein the first platform includes a portion that extends centrally.

17. The exercise machine of claim 12, including a second platform attached to the frame near the second end of the frame.

18. A method of using the exercise machine of claim 12, comprising:

positioning the exerciser on the carriage;

gripping the handle with the hand of the exerciser with the plurality of fingers of the hand extending through the opening; and applying a force to the carriage by the exerciser.

19. An exercise machine, comprising:

a frame having a first end, a second end opposite of the first end, a first rail, and a second rail that is parallel to the first rail;

a carriage movably positioned upon the first rail and the second rail, wherein the carriage includes an upper surface;

a first spring and a second spring each adapted to be connected to the carriage to provide a tension force to the carriage;

a first platform attached to the frame near the first end of the frame, wherein the first platform includes a first upper surface and an inner edge, wherein the inner edge of the first platform faces a direction generally towards the carriage;

wherein the first platform includes a portion that extends centrally;

a handle having a longitudinal axis, wherein the longitudinal axis of the handle is in a fixed position near or on a plane formed by the first upper surface of the first platform;

wherein the handle is elongated;

wherein the handle is straight;

wherein the handle is cylindrical;

wherein the handle is covered with a grip or a cushion grip;

wherein the longitudinal axis of the handle, the upper surface of the carriage and the first upper surface of the first platform are parallel to one another;

wherein the handle includes a first end and a second end opposite of the first end of the handle, wherein the first end and the second end of the handle are connected to the first platform;

wherein the first platform includes a cutout positioned at the inner edge of the first platform, wherein the handle is at least partially positioned within the cutout; and an opening between the handle and the inner edge of the first platform, wherein the opening is large enough to allow a plurality of fingers of a hand of an exerciser to be inserted into the opening, wherein the handle is distally spaced from the inner edge of the first platform by a distance sufficient for the plurality of fingers to extend into the opening between the handle and the inner edge of the first platform;

wherein the opening is elongated and extends in a direction substantially parallel with respect to the handle.

20. The exercise machine of claim 19, wherein the handle is rotatable about the longitudinal axis of the handle.

21. A method of using the exercise machine of claim 19, comprising:

positioning the exerciser on the carriage;

gripping the handle with the hand of the exerciser with the plurality of fingers of the hand extending through the opening; and applying a force to the carriage by the exerciser.

22. An exercise machine, comprising:

a frame having a first end, a second end opposite of the first end, and at least one rail;

a carriage movably positioned upon the at least one rail and wherein the carriage includes an upper surface;

a first tension member adapted to be connected to the carriage to provide a tension force to the carriage;

a first platform attached to the frame near the first end of the frame, wherein the first platform includes a first upper surface and an inner edge, wherein the inner edge of the first platform faces a direction generally towards the carriage;

a first handle having a first longitudinal axis, wherein the first longitudinal axis of the first handle is in a fixed position near or on a plane formed by the first upper surface of the first platform;

wherein the first longitudinal axis of the first handle, the upper surface of the carriage and the first upper surface of the first platform are parallel to one another;

wherein the first handle includes a first end and a second end opposite of the first end of the first handle, wherein the first end and the second end of the first handle are connected to the first platform;

wherein the first platform includes a first cutout positioned at the inner edge of the first platform, wherein the first handle is at least partially positioned within the first cutout;

an first opening between the first handle and the inner edge of the first platform, wherein the first opening is large enough to allow a plurality of fingers of a first hand of an exerciser to be inserted into the first opening, wherein the first handle is distally spaced from the inner edge of the first platform by a first distance sufficient for the plurality of fingers of the first hand to extend into the first opening between the first handle and the inner edge of the first platform;

wherein the first opening is elongated and extends in a direction substantially parallel with respect to the first handle;

a second handle having a second longitudinal axis, wherein the second longitudinal axis of the second handle is in a fixed position near or on a plane formed by the first upper surface of the first platform;

wherein the second longitudinal axis of the second handle, the upper surface of the carriage and the first upper surface of the first platform are parallel to one another;

wherein the second handle includes a first end and a second end opposite of the first end of the second handle, wherein the first end and the second end of the second handle are connected to the first platform;

wherein the first platform includes a second cutout positioned at the inner edge of the first platform, wherein the second handle is at least partially positioned within the second cutout; and an second opening between the second handle and the inner edge of the first platform, wherein the second opening is large enough to allow a plurality of fingers of a second hand of the exerciser to be inserted into the second opening, wherein the second handle is distally spaced from the inner edge of the first platform by a second distance sufficient for the plurality of fingers of the second hand to extend into the second opening between the second handle and the inner edge of the first platform;

wherein the second opening is elongated and extends in a direction substantially parallel with respect to the second handle.

23. The exercise machine of claim 22, wherein the first handle is rotatable about the first longitudinal axis of the first handle.

24. The exercise machine of claim 22, wherein the first tension member is comprised of a spring.

25. The exercise machine of claim 22, wherein the first handle is cylindrical.

26. The exercise machine of claim 22, wherein the first handle is covered with a grip or a cushion grip.

27. The exercise machine of claim 22, wherein the first platform includes a portion that extends centrally.

* * * * *